US012161236B2

(12) United States Patent
Djankovich

(10) Patent No.: US 12,161,236 B2
(45) Date of Patent: Dec. 10, 2024

(54) LOWERING ASSIST DEVICE

(71) Applicant: Rocking Inc., Winnetka, IL (US)

(72) Inventor: Mladen Djankovich, Winnetka, IL (US)

(73) Assignee: Rocking Inc., Winnetka, IL (US)

( * ) Notice: Subject to any disclaimer, the term of this patent is extended or adjusted under 35 U.S.C. 154(b) by 260 days.

(21) Appl. No.: 17/949,945

(22) Filed: Sep. 21, 2022

(65) Prior Publication Data

US 2023/0090787 A1 Mar. 23, 2023

Related U.S. Application Data

(60) Provisional application No. 63/246,595, filed on Sep. 21, 2021.

(51) Int. Cl.

| | |
|---|---|
| ***A47D 15/00*** | (2006.01) |
| ***A47D 9/00*** | (2006.01) |
| ***A47D 13/08*** | (2006.01) |

(52) U.S. Cl.

CPC ..... *A47D 15/00* (2013.01); *A47D 9/00* (2013.01); *A47D 13/08* (2013.01)

(58) Field of Classification Search

CPC ..... A47D 15/00; A47D 9/00; A47D 13/08
USPC ..... 248/118
See application file for complete search history.

(56) References Cited

U.S. PATENT DOCUMENTS

| | | | | |
|---|---|---|---|---|
| 3,193,849 A * | 7/1965 | Landry | A47D 9/012 5/100 |
| 11,701,273 B2 * | 7/2023 | Pattee | B60N 2/14 414/541 |
| 2022/0142375 A1 * | 5/2022 | Hu | A47D 15/00 |

* cited by examiner

*Primary Examiner* — Todd M Epps
(74) *Attorney, Agent, or Firm* — K&L Gates LLP

(57) ABSTRACT

A lowering assist device includes first and second track housings, first and second resistance mechanisms, and first and second platforms. Each track housing includes a front face, a rear face, and opposing side faces and further includes an internal shaft and an internal member vertically movable along the internal shaft. Each resistance mechanism is housed within the respective track housing and is configured to provide a biasing force to the respective internal member as the respective internal member moves within the respective track housing. Each platform is mounted to the respective internal members.

15 Claims, 5 Drawing Sheets

LOWERING ASSIST DEVICE

CROSS-REFERENCE TO RELATED APPLICATIONS

This application claims the benefit of priority to U.S. Provisional Application No. 63/246,595 filed Sep. 21, 2021, the disclosure of which is incorporated herein by reference.

BACKGROUND

The present disclosure relates to a lowering assist device for use with a structure such as a crib. More specifically, the present disclosure is directed to a lowering assist device that attaches to a side of crib and assists a caregiver when lowering a baby or toddler into the crib.

While designed for the safety of the child, cribs are typically structured at uncomfortable heights for the parents and caregivers. Safety requirements recommend that the mattress to be a minimum of about 26 inches below the top of the side of the crib. As the baby grows into a toddler or small child, the crib mattress must be lowered to accommodate the child's development from rolling to sitting to pulling himself up to a standing position to trying to climb out of the crib. The top of the rail or sidewall is typically between waist- and chest-level of the parent or caregiver, and positioning the child on the crib mattress requires the caregiver to hold the baby or toddler, ranging in weight from about 6 lbs up to about 40 lbs, with the caregiver's arms in an outstretched, unsupported position at a distance from the caregiver's body, slowing lowering the child onto the mattress to avoid any sudden movements that could disturb the child's sleep.

The baby or toddler is often rocked, fed, or held in the parent or caregiver's arms until they fall asleep, at which point the parent carries the child to the crib and places the child onto the crib mattress. The moment at which the parent transitions the sleeping child from the parent's arms onto the crib mattress is a critical point in the napping or bedtime routine—any sudden movement, drop, abrupt shift in upper body of the caregiver while lowering the child down to the mattress, etc., could cause the child to wake up, leading to additional rounds of calming, feeding, and rocking the child back to sleep. For babies that are sick or colicky, the pressure during this moment of transition is heightened. Any disruption during the beginning of the sleep cycle could lead to hours of unrest.

One of the difficulties of crib use is lower back pain that many parents and caregivers experience when lowering the child into the crib. The action of extending the child away from the body and then lowering the child to the crib mattress, up to a distance of 26 or more inches, puts a significant amount of pressure on the caregiver's lumbar spine. This area of the body tends to weaken with age due to genetics, heavy sports involvement at a younger age, accidents, working in predominantly sitting or standing positions, or pregnancy. Grandparents and older caretakers may be limited in their ability to carry or lift the child, much less slowly lower the child into the crib. Any amount of weight, from newborn babies to toddlers, can create pressure on the lower back during this poorly supported motion.

Lower back pain can be gradual and dull, and develop into acute pain particularly after prolonged periods spent sitting or standing. A person experiencing lower back pain can reach a breaking point in response to even a slight, subtle movement, such as leaning over the bathroom sink to brush teeth or lifting groceries. The breaking point can be experienced as a herniated disc, a pinched nerve, or other sudden extreme discomfort, rendering the parent or caregiver immobile for days or weeks. The repeated action of bending over a crib to lower the baby or toddler into place can worsen lower back problems, leading to serious or extreme discomfort that could interfere with the caregiver's quality of life, including the ability to care for the child.

In addition to the risk of developing or increasing lower back stress, another problem related to crib use is the difficulty in maintaining stability while holding the child in outstretched arms and lowering the child onto the crib mattress. Stability is important not only to avoid waking the child, but also to minimize anxiety and provide a calm nervous system as the child is transitioned to the crib. Infants in particular have the Moro reflex, in which they flail their arms and cry in response to a sudden loss of support. Experiencing the Moro reflex can be highly stressful on the infant's central nervous system.

Accordingly, there is a need for a device to support the caregiver's upper body, to alleviate pressure on the caregiver's lower back, and to stabilize the child as the caregiver holds the child away from the body above the mattress and lowers the child into a crib, as described herein.

SUMMARY

To meet the needs noted above and others, the present disclosure provides a lowering assist device that attaches to an inner surface of a sidewall of a crib and provides support to the caregiver's arms as the caregiver places the child into the crib. More specifically, the lowering assist device includes a set of platforms that move along a set of vertical track housings on the side of a crib, the platforms being biased upwardly by a resistance mechanism. Force applied by the resistance mechanism supports the caregiver's upper body, including the lower back, the torso or trunk, and the arms.

By providing support to the caregiver's upper body as they place the child in the crib, the lowering assist device relieves pressure in the parent's lower back, ensures a smooth transition of the child from the caregiver's arms into the crib, and stabilizes the child throughout the movement.

In one example embodiment, the lowering assist device includes first and second track housings that are secured to an inner surface of a crib sidewall. The embodiments described herein demonstrate the use of the lowering assist device to lower a baby or toddler into a crib, although the lowering assist device may be used on any structure to lower any item or object as needed.

In the embodiment described herein, each track housing has a longitudinal shape including a front face, a rear face, and opposing side faces. An internal member moves vertically within the track housing along an internal shaft. The front face includes a slot extending along a height thereof. The internal member includes a mounting surface that is external to the track housing for engaging with the platform as noted below.

A resistance mechanism provided within each track housing is configured to provide resistance to the respective internal member as the internal member moves downward along the internal shaft. For example, the resistance mechanism may comprise a compression spring positioned about the internal shaft that biases the internal member upwards. In other embodiments, the resistance mechanism may include a gas spring, a linear or tension spring, a buoyant or resilient foam, a plurality of springs, any combination of the aforementioned, or any other suitable biasing element.

The resistance mechanism may also include a rotary dampener or other dampening element that applies further resistance through the internal member as the internal member moves upward with the compression spring. In some embodiments, the rotary dampener also applies resistance as the internal member moves downward against the compression spring. A spring return, a dashpot, or any other suitable dampening element may also or alternatively be used.

The set of platforms includes first and second platforms, each attached to the respective internal member of the respective track housing. In some embodiments, the platform is an elbow cup sized to receive the elbow and partial forearm of the caregiver. In other embodiments, the platform may include a planar or otherwise curved surface that engages the elbow alone or a greater portion of the forearm. Each platform also includes a mounting component that engages with the mounting surface of the internal member.

In one embodiment, the mounting surface of the internal member includes a lug with a horizontal bore extending therethrough. The mounting component of the platform includes first and second protrusions, each including a central opening. During use, the mounting surface is positioned between the first and second protrusions of the mounting component. A pin is inserted through the aligned openings and bore, and one or more torsion springs are positioned along the pin to bias the platform into a retracted position. For example, a first spring is positioned between the first protrusion and the lug and a second spring is positioned between the second protrusion and the lug. Pressure applied to the platform against the bias of the torsion springs moves the platform from the retracted position into an extended position.

In some embodiments, each track housing includes an upper end and a lower end of the longitudinal housing with a bracket at the upper end. The bracket straddles the top edge of the crib sidewall or other structure. The bracket may include a clamp mechanism configured to tighten onto the side surface of the structure. In other embodiments, a suction cup secured to the rear face at the upper end of the track housing securely holds the track housing to the crib sidewall. Alternatives to the clamp mechanism and/or suction cup such as safety straps, a series of bolts screwed directly into a wooden crib, cable ties for mesh cribs, or other securement means may also be used as well.

At the lower end of each track housing, a rotatable knob having a threaded shaft may be inserted into a bore near the lower end of the railing. With the rails positioned on the crib, the rotatable knob holds the rail against the crib and secures the lower end thereof in place. In alternative embodiments, the lower end of each track housing is snugly held in place through a friction fit between the crib mattress and the sidewall of the crib alone. In some embodiments, a suction cup secured to the lower end of the rear face of the track housing engages with the crib sidewall. Other suitable securement means may also be used.

An object of the invention is to provide a force or resistance to the upper body of the caregiver as the caregiver positions the child away from the body and above the crib and then lowers the child into a crib, thereby relieving and/or avoiding lower back pain.

Another object of the invention is to provide a solution to smoothly transition a sleeping child from the caregiver's arms into the crib.

A further objective of the invention is to maintain a stable motion for the benefit of the child, to avoid any stress and anxiety that a child would experience in response to a sudden movement or drop by the caregiver.

An advantage of the invention is that the caregiver can easily pause as they lower the child into the crib. If the child stirs or responds to the movement, the caregiver can pause and allow the child to calm themselves down rather than return the child to the caregiver's arms.

An advantage of the invention is that it may also provide support to the parent as the parent lifts the baby or toddler out of the crib.

Additional objects, advantages, and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

Figure 1:
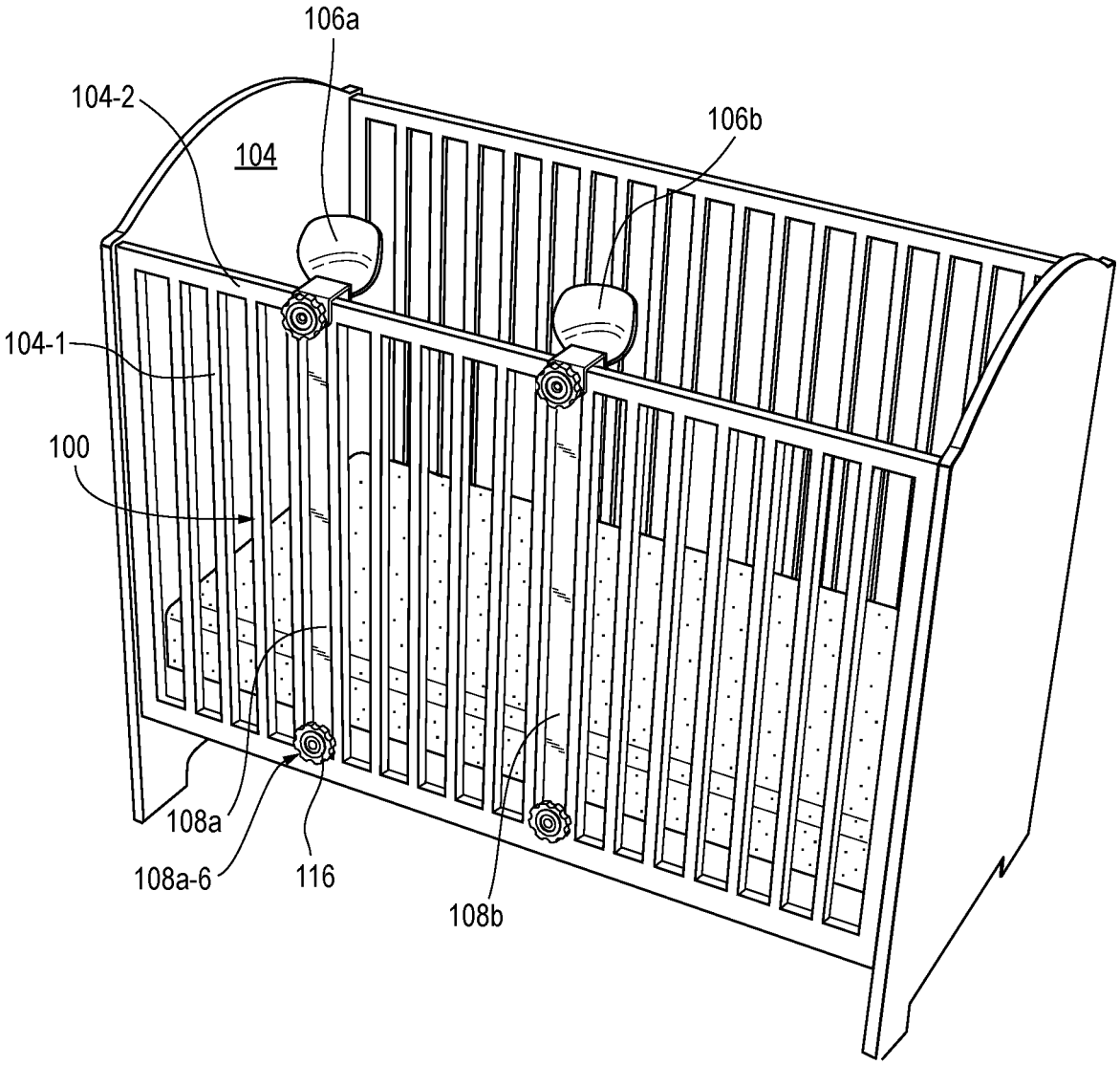
FIG. 1 is a perspective view of the lowering assist device positioned on a baby crib.

FIGS. 1-8 illustrate an example lowering assist device 100 according to the present disclosure. In the illustrated embodiments, the lowering assist device 100 attaches to an inner vertical surface 104-1 of a structure 104, such as a crib as illustrated in the figures, and assists a parent or caregiver in lowering a baby into the structure 104. The lowering assist device 100 includes first and second platforms 106*a*, 106*b* that move vertically along first and second track housings 108*a*, 108*b*, respectively. Movement of the platforms 106 down the track housings 108 is controlled by a resistance mechanism 110. During use, the caregiver positions their elbows on the platforms 106 and controllably lowers the baby into the crib. The lowering assist device 100 provides support to the parent's upper body via the elbows as the parent lowers the child into the crib 104.

Figure 2:
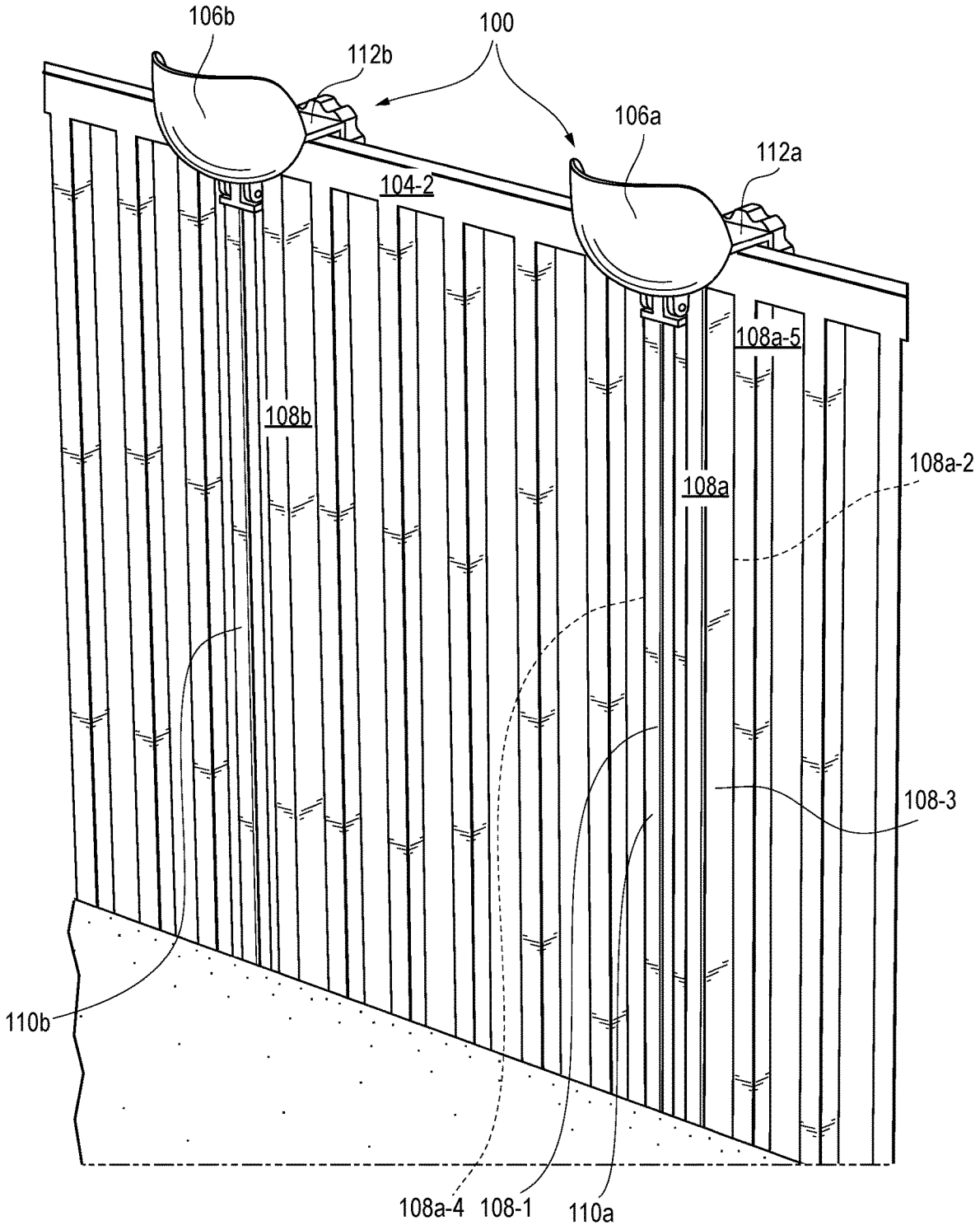
FIG. 2 is a perspective view of the lowering assist device of FIG. 1 from the inside of the crib.

Referring to FIGS. 1 and 2, the lowering assist device or mechanism 100 includes first and second track housings 108*a*, 108*b* that mount onto a sidewall of a crib 104. In the illustrated embodiment, each track housing 108 has a longitudinal shape and includes a front face 108-1, a rear face 108-2, and opposing side faces 108-3, 108-4 extending between an upper end 108-5 and a lower end 108-6. While the embodiment illustrated in FIGS. 1-8 and described herein demonstrates the lowering assist device 100 used to assist in lowering a baby into a crib 104, the lowering assist device 100 may be utilized on any suitable structure and assist in lowering any object or item onto a lower surface, such as placing packages or boxes in storage containers at a warehouse, placing boxes of documents in storage containers in office spaces, etc.

As shown in FIGS. 3-6, a bracket 112 at the upper end 108-5 straddles a top edge 104-2 of the crib sidewall 104-1 or other suitable structure. For example, the bracket 112 may include a planar surface 112-1 secured to the top edge 104-2 of the rail 104-1 and a downwardly extending front surface 112-2 transverse to the planar surface 112-1.

Figure 4:
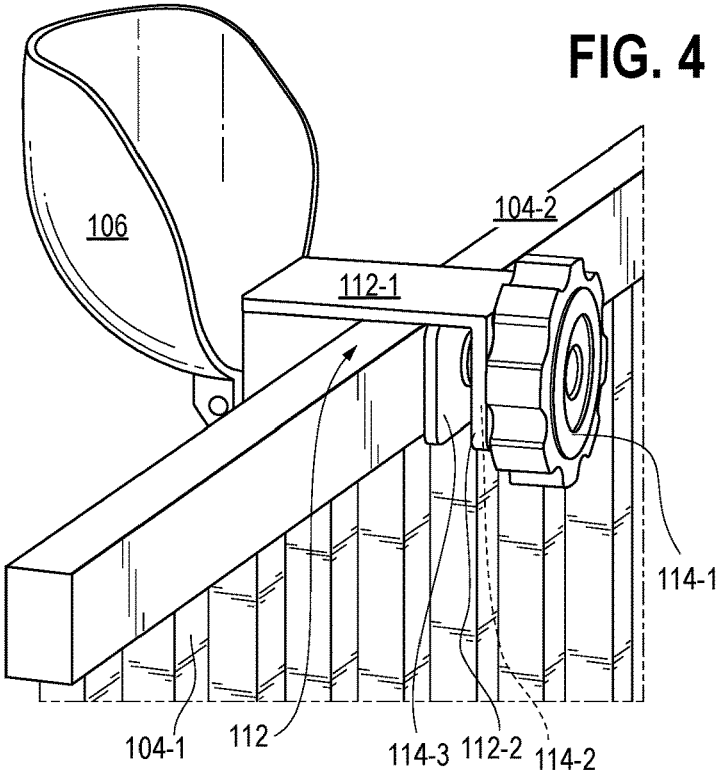
Figure 6:
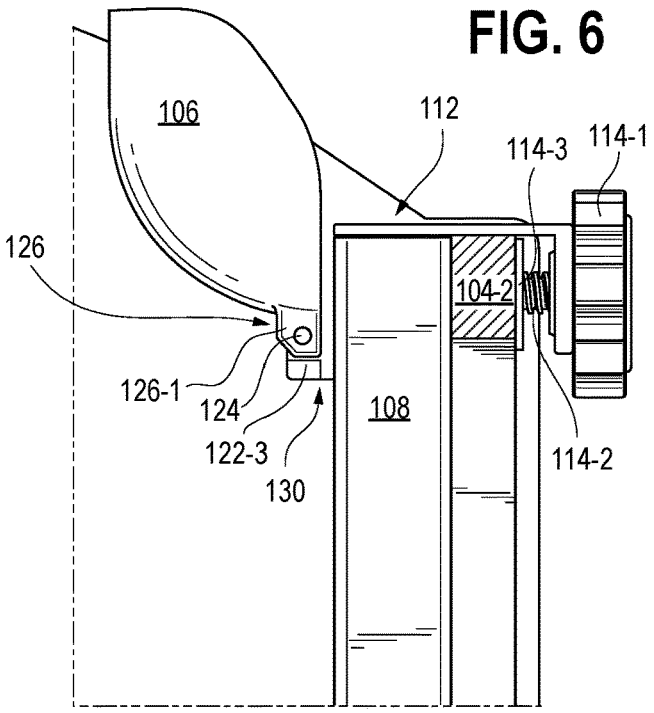

The positioning of the downwardly extended front surface 112-2 is adjustable to accommodate crib sidewalls 104-1 having varied dimensions, seen clearly in FIGS. 4 and 6. A clamp mechanism 114 on the bracket 112 tightens or secures the bracket 112 in place on the crib sidewall 104-2. In one embodiment, the clamp mechanism 114 includes a knob 114-1 with a threaded shaft 114-2 is inserted through a bore on the downwardly extending surface 112-2. A planar surface 114-3 may be attached to an end of the threaded shaft 114-2 to distribute pressure onto the interfacing surface of the crib sidewall 104-1. During use, the knob 114-1 is rotated until the planar surface 114-3 strikes the crib sidewall 104-2 and secures the bracket 112 in place. In other embodiments, the surface 114-3 may be biased away from the surface 112-2 through a spring in lieu of use of the knob 114-1 and the threaded shaft 114-2.

At the lower end 108-6 of each track housing 108 as shown in FIG. 1, the track housing 108 includes a bore that receives a threaded shaft of a lower rotatable knob 116. During use, once the bracket 112 at the upper end 108-5 of the track housing 108 is secured in place, the lower knob 116 is rotated to secure the lower end 108-6 of the track housing 108 to the crib sidewall 104-1. In other embodiments, the lower end 108-6 of the track housing 108 is secured to the crib or structure 104 through other means such as magnets, suction cup, male/female connectors, or any other suitable means.

Figure 5:
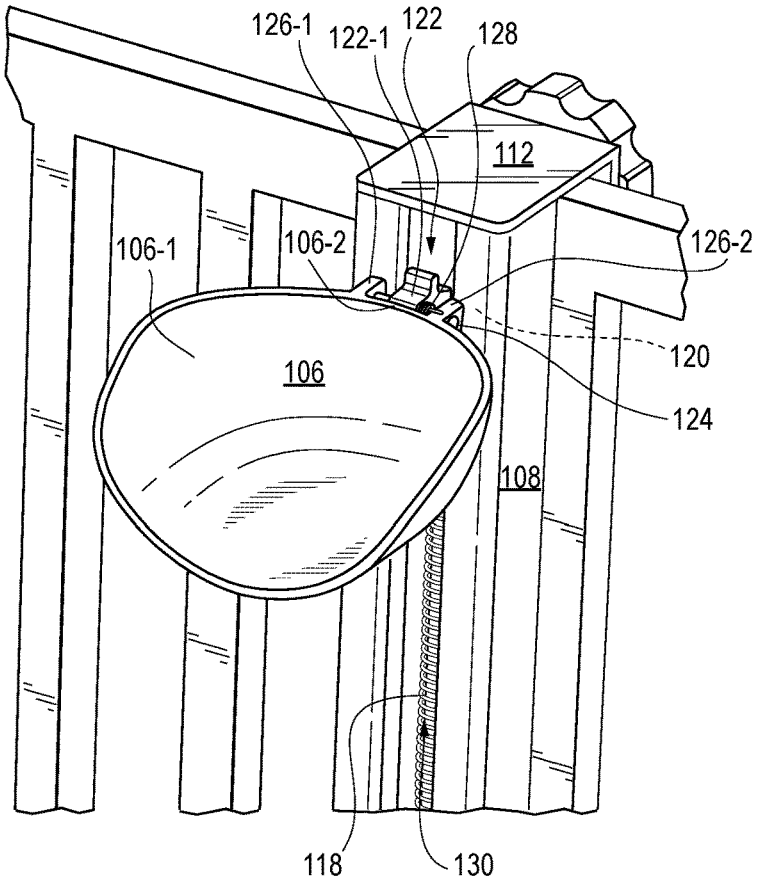
FIGS. 5 and 6 are perspective and side elevational, enlarged views of the top bracket and the platform of the lowering assist device of FIG. 1.
Figure 7:
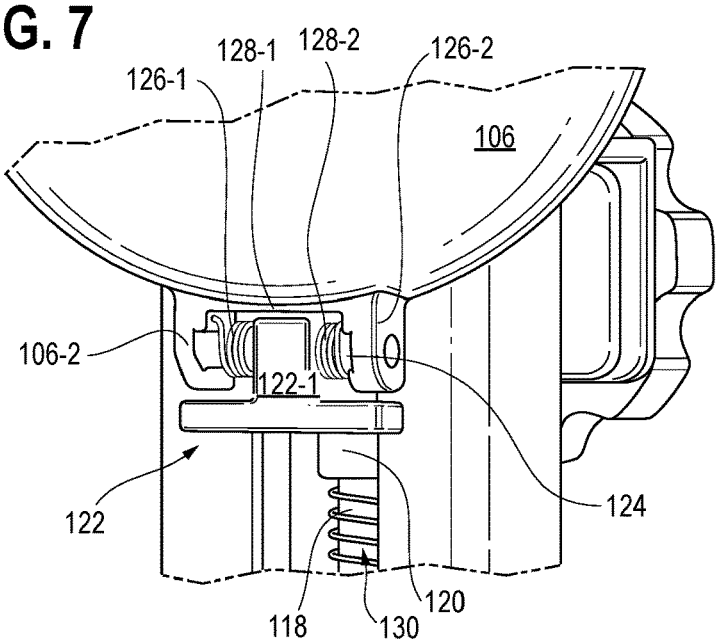
FIG. 7 is a perspective, enlarged view of the platform and the internal member of the lowering assist device of FIG. 1.

As shown in FIGS. 5 and 7, an internal shaft 118 is positioned between the upper and lower ends 108-5, 108-6 of each track housing 108. An internal member 120 moves vertically along the internal shaft 118. In some embodiments, the internal member 120 is a planar plate having a central bore through which the internal shaft 118 extends. In other embodiments, the internal member 120 includes a planar plate having a U-shape, with a back portion of the U-shape between the internal shaft and the rear face of the track housing.

FIG. 7 illustrates a mounting surface 122 on the internal member 120 that is external to the track housing 108 and onto which the respective platform 106 is attached. The mounting surface 122 includes a lug 122-1 that attaches to the planar plate along the slot 108-7 of the front face 108-1 of the track housing 108. In the illustrated embodiment, the lug 122-1 includes a bore 122-2 through which a pin 124 is inserted as described in greater detail below. The lug 122-1 is mounted on a stop plate 122-3, against which the platform 106 rests in the extended position.

Also shown in FIGS. 5 and 7, each platform 106 includes a surface 106-1 for receiving an elbow and a portion of the forearm of the caregiver during use. In the illustrated embodiment, the platform 106 comprises an elbow cup, although any suitable structure may be used. The platform 106 may be shaped to receive a greater portion of the forearm or the elbow alone. The platform 106 may be a planar or otherwise curved surface, and/or may include padding.

Seen best in FIG. 7, the platform 106 includes a mounting component 126 that engages with the mounting surface 122 of the internal member 120. In the illustrated embodiment, the mounting component 126 includes first and second protrusions 126-1, 126-2 extending from an edge 106-2 of the platform 106. During use, the mounting surface 122 of the internal member 120 is positioned between the first and second protrusions 126-1, 126-2 of the platform 106.

Each protrusion 126-1, 126-2 of the mounting component 126 of the platform 106 includes an opening 126-3, 126-4, and the openings 126-3, 126-4 are aligned with the bore 122-2 of the mounting surface 122 during use. The pin 124 is inserted through the aligned protrusion openings 126-3, 126-4 and the bore 122-2 of the mounting surface 122, with a torsion spring 128-1, 128-2 being positioned between each protrusion 126 and the respective side of the mounting surface 122.

The pin 124 provides a pivot point about which the platform 106 rotates, and the torsion springs 128-1, 128-2 bias the platform 106 into a vertical, retracted position as shown in FIG. 6. During use, the caregiver uses their elbows to push the platform 106 into a horizontal, extended position as shown in FIG. 5 against the bias of the torsion springs 128-1, 128-2. Other alternatives for attaching the platform 106 to the internal member 120 of the track housing 108 may be used as desired.

In some embodiments, the resting position of the platform 106 includes a positioning of the platform 106 atop the track housing 108. For example, the mounting surface 122 is moveable on the internal member such that it moves from a front edge of the internal member outside of the front face 108-1 of the track housing 108 (as seen in FIGS. 5 and 6) to a top surface of the internal member when the internal member is positioned at the top of the upper end of the track housing 108. A torsion spring or other biasing element may be used to urge the mounting surface 122 to the top surface of the internal member. In this embodiment, the platform 106 is positioned above the top edge of the crib sidewall in the resting position. The platform 106 may include a curved or otherwise hooking surface on an outer edge thereof so that the caregiver can easily manipulate the platform 106 from the resting position into the extended position and move the platform 106 onto the front edge of the internal member 120 and down the slot 108-7 of the front face 108-1 of the track housing 108.

In some embodiments, the lowering assist device 100 includes a foot pedal or a button at the upper end 108-5 of the track housing 108 that, when activated, causes the platforms 106 to move between the retracted position and an extended position near the upper end 108-5 of the track housing. In still other embodiments, the platform 106 may be locked in the retracted position and unlocked through a foot pedal or a button at the upper end 108-5 of the track housing 108.

Referring to FIGS. 5 and 7, a resistance mechanism 130 is positioned within each track housing 108 to bias the internal member 120 upwardly toward the upper end 108-5 of the track housing 108 into a resting position. Each of first and second platforms 106 moves vertically along the respective slot 108-7 of the respective track housing 108, and the resistance mechanism 130 applies an upward pressure to the platform 106 which supports the caregiver's upper body as they lower the child into the crib.

In one embodiment, the resistance mechanism 130 is a compression spring positioned about the internal shaft 118 below the internal member 120. The resistance mechanism 130 may alternatively include a gas spring with a spring return, a linear or tension spring, a resilient or buoyant foam, or any other suitable biasing mechanism or structure. In some embodiments, the force of the resistance mechanism 130 is adjustable to accommodate different caretakers and their varying weights and upper body strengths, as well as to allow the caretaker to increase resistance substantially when using the lowering assist device 100 as they pick the child up and out of the crib.

In some embodiments, the track housing 108 includes a cover that is vertically compressible along the slot 108-7 in order to block access to the resistance mechanism 130. An upper edge of the cover attaches to the underside of the internal member so that the cover expands and compresses with the internal member 120 as the internal member 120 moves vertically within the track housing 108.

The platforms 106 move downwardly along the track housing 108 at a slow, controlled speed as the resistance mechanism 130 applies an upward force against the force of the caregiver. Once the child is positioned on the crib mattress, the caregiver can remove their arms from the platforms 106, allowing the resistance mechanism 130 to bias the platforms 106 upwardly to the resting position. The resistance mechanism 130 may also include a dampener so that the return biasing is also controlled, enabling the platforms 106 to return to the resting position slowly and smoothly. The return biasing is controlled in order to minimize any risk to the child in the crib and to avoid any damage to the internal components of the lowering assist device 100.

In one embodiment, the dampener is a rotary dampener that applies resistance through the internal member 120 as the internal member 120 moves upward with the compression spring or other biasing element 130. In some embodiments, the rotary dampener also applies resistance as the internal member 120 moves downward against the compression spring 130.

Alternatively, the resistance mechanism may include a gas or pneumatic spring, a linear or tension spring, a resilient or buoyant foam, or other suitable biasing element in lieu of the compression spring. A spring return, a dashpot, or any other suitable mechanism may also be used instead of or in addition to the rotary dampener.

Figure 3:
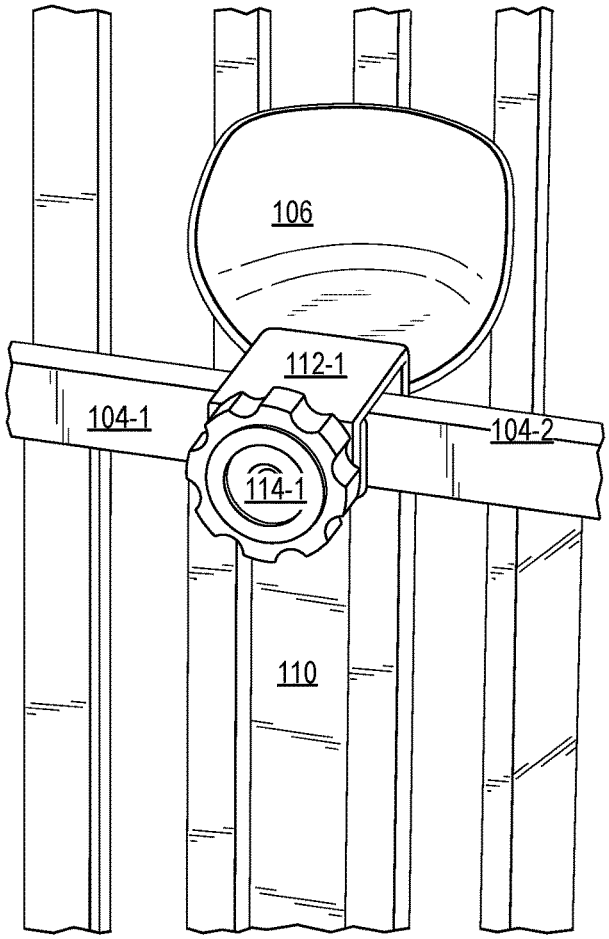
FIGS. 3 and 4 are perspective, enlarged views of the top bracket on a rail of the lowering assist device of FIG. 1.
Figure 8:
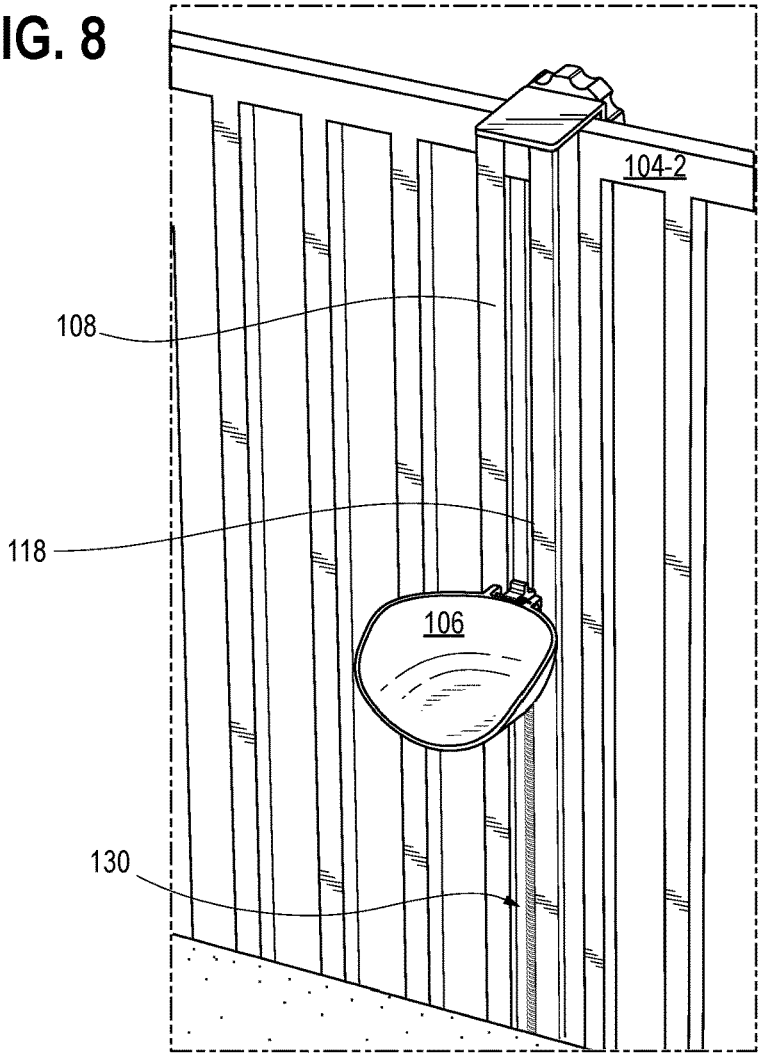
FIG. 8 is a perspective view of the lowering assist device of FIG. 1 showing the platform at a midpoint along the rail.

Use of the lowering assist device 100 will be described in reference to the crib, as illustrated. Holding and carrying the baby, the caregiver approaches the sidewall of the crib and extends the baby above the crib mattress. Prior to use, the platforms are positioned in the resting position at the upper end of the track housing (FIG. 2). The caregiver positions his elbows on the platforms, moving the platforms from the retracted position (FIGS. 3 and 4) into the engaged position (FIG. 5). The caregiver then gently lowers the baby toward the crib mattress, moving the platforms downwardly along the track housing (FIG. 8). Once the baby is resting on the mattress, the caregiver moves his hands away from the baby and releases pressure on the platforms, allowing the platforms to move from the engaged position (FIG. 5) to the retracted position (FIGS. 3 and 4). The resistance mechanism also biases the platforms upward into the resting position along the track housing (FIG. 2).

It should be noted that various changes and modifications to the presently preferred embodiments described herein will be apparent to those skilled in the art. Such changes and modifications may be made without departing from the spirit and scope of the present invention and without diminishing its attendant advantages. For example, various embodiments of the systems and methods may be provided based on various combinations of the features and functions from the subject matter provided herein.

What is claimed is:

1. A lowering assist device configured to attach to a structure, the lowering assist device comprising:

first and second track housings, each track housing including a front face, a rear face, and opposing side faces and further including an internal shaft and an internal member vertically movable along the internal shaft within the track housing, wherein the front face includes a vertical slot;

first and second resistance mechanisms housed within the first and second track housings, respectively, wherein each resistance mechanism is configured to provide resistance to the respective internal member as the respective internal member moves within the respective track housing; and first and second platforms mounted to the first and second internal members, respectively;

wherein the first and second track housings are configured to attach to a side surface of the structure.

2. The lowering assist device of claim 1, wherein each resistance mechanism biases the respective internal member toward an upper end of the respective track housing.

3. The lowering assist device of claim 1, wherein each platform is attached to the respective internal member at a pivot point, and wherein each platform pivots about the pivot point between an extended position and a retracted position.

4. The lowering assist device of claim 3, wherein each internal member includes a mounting surface, wherein each platform includes a mounting component configured to engage the respective mounting surface of the respective internal member, and wherein the pivot point includes a pin extending along aligned openings within the mounting component and the mounting surface and one or more torsion springs that urge the respective platform into the retracted position.

5. The lowering assist device of claim 1, wherein each platform comprises an elbow cup.

6. The lowering assist device of claim 1, wherein each track housing includes an upper end and a lower end of the longitudinal housing and a bracket at the upper end, wherein the bracket is configured to be secured to an upper edge of the side surface of the structure.

7. The lowering assist device of claim 6, wherein the bracket includes a clamp mechanism configured to tighten onto the side surface of the structure.

8. The lowering assist device of claim 7, wherein the bracket includes a top planar surface and a transverse side surface extending from the top planar surface, and the clamp mechanism includes a bore within the transverse side surface and a knob attached to a threaded shaft that extends through the bore.

9. The lowering assist device of claim 6, wherein each track housing further includes a lower knob received within a bore adjacent to the lower end of the track housing.

10. The lowering assist device of claim 1, wherein the resistance mechanism comprises one of a compression spring, a gas spring, or a linear spring on the internal shaft within the respective track housing, wherein the compression spring biases the internal member upward toward the upper end of the track housing.

11. The lowering assist device of claim 10, wherein the resistance mechanism comprises a rotary dampener configured to apply resistance to the biasing force applied to the internal member moves upward within the track housing.

12. The lowering assist device of claim 11, wherein the rotary dampener is configured to apply resistance as the internal member moves downward against the compression spring.

13. The lowering assist device of claim 11, wherein the rotary dampener is secured to the upper end or the lower end of the track housing.

14. The lowering assist device of claim 11, wherein the rotary dampener is secured to the internal member.

15. The lowering assist device of claim 10, wherein the resistance mechanism further comprises a spring return.

* * * * *